United States Patent [19]

Echevarria

[11] Patent Number: 4,923,107

[45] Date of Patent: May 8, 1990

[54] STAPLING MACHINE

[75] Inventor: Jorge G. Echevarria, Eibar, Spain

[73] Assignee: Olave, Solozabal Y CIA, S.A., Spain

[21] Appl. No.: 269,860

[22] Filed: Nov. 10, 1988

[51] Int. Cl.[5] ..... B25C 1/02

[52] U.S. Cl. ..... 227/120; 227/110

[58] Field of Search ..... 283/110, 111, 120

[56] References Cited

U.S. PATENT DOCUMENTS

| | | | |
|---|---|---|---|
| 2,358,463 | 9/1944 | Masters | 227/110 |
| 2,530,152 | 11/1950 | Corwin | 227/110 X |
| 3,302,842 | 2/1967 | MacEachron | 227/110 X |
| 3,477,628 | 11/1969 | MacEachron | 227/110 |

FOREIGN PATENT DOCUMENTS

| | | | |
|---|---|---|---|
| 8500313 | 1/1985 | PCT Int'l Appl. | 227/110 |
| 2148773 | 6/1985 | United Kingdom | 227/110 |

*Primary Examiner*—Paul A. Bell

*Attorney, Agent, or Firm*—Lucas & Just

[57] ABSTRACT

An improved stapling machine is disclosed which comprises a support base with a one-piece configuration capable of flexing and which defines two wings, one for support which forms a slightly sloping anvil and another for carrying the stapling-machine head/staple holder, which are connected together via a curved core; and a guide rule, fitted on said sloping anvil and defining the point-bending cavity opposite the stapling head.

6 Claims, 1 Drawing Sheet

STAPLING MACHINE

The present invention relates to an improved stapling machine.

Stapling and paper-fastening machines have been known for a long time, and at present there are in existence stapling machines of various types (of a desk type, of a plier type, etc.).

These stapling machines/paper-fastening machines are unsuitable for some uses (for example, when it is required to staple volumes of catalogues, leaflets, books or the like).

Therefore, it is a matter of designing a stapling machine/paper-fastening machine whose configuration makes it possible to resolve the current limitations and, at the same time, makes it possible that all identical items (for example, in the same series) have the staple(s) arranged exactly in the same place.

To this end, the improved stapling machine according to the invention is constructed with:

(a) a support base with a one-piece configuration capable of flexing and which defines two wings, one for support which forms a slightly sloping anvil and another for carrying the stapling-machine head/staple holder, which are connected together via a curved core;

(b) a guide rule, fitted on said sloping anvil and defining the point-bending cavity opposite the stapling head.

It is also defined in that the stapling-machine head/-staple holder is mounted so as to articulate on the support base and includes a spring plate fixed to the support base and on which the stapling-machine head/staple holder rests, tending to remain in one position.

It is also defined in that said guide rule is constructed as a one-piece body arranged transversely on the sloping anvil via one of its end zones and defining a support at the opposite end zone and positioning shapes distributed over its entire width so that the staples are accurately positioned on identical items whilst at the same time avoiding tilting of said rule during stapling.

Figure 1:
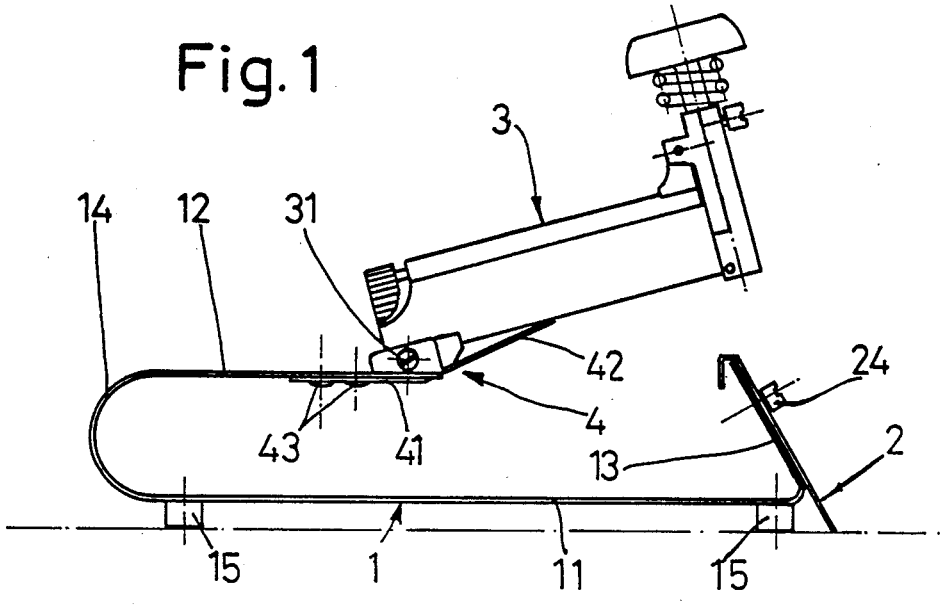
FIG. 1 shows a general view in elevation of the stapling machine according to the invention.
Figure 2:
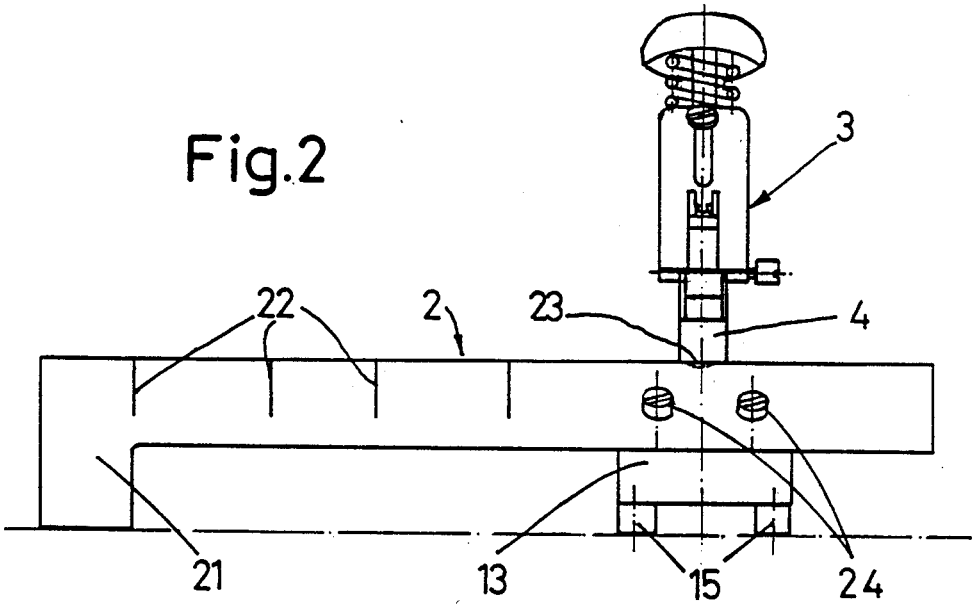
FIG. 2 shows a front view corresponding to FIG. 1.

The principal elements of the stapling machine and its working arrangement may be seen in both figures.

A non-limiting exemplary embodiment of the present invention is described below. Other embodiments in which additional changes are introduced but which do not detract from its basic principle are in no way excluded; on the contrary, the present invention also encompasses all alternative embodiments thereof.

According to the invention and according to the embodiment represented, the improved stapling machine is costructed from:

a support base (1), a guide rule (2), the stapling-machine head/staple holder (3).

The support base (1) is a one-piece body which, in elevation, has a general "U" shape with its arcuate core (14) and its wings (11),(12), which are of unequal length, arranged horizontally.

A sloping anvil (13) is formed at the end of its larger horizontal wing (11); supports (15) are arranged underneath this horizontal wing (11).

At the end of its smaller horizontal wing (12) is mounted the stapling-machine head/staple holder (3) which is articulated at (31) so that the head (3) may rotate with respect to the support (1) and the wing (12) of the latter may flex by virtue of the curved configuration of the core (14).

The head (3) is held in one position with respect to the support (1) by virtue of a spring plate (4)—see FIG. 1.

This spring plate (4) defines two zones (41) (42) in a different plane; it is fitted via its zone (41) on the wing (12) of the support (1) by means of, for example, screws (43) and on the end of its other zone (42) it supports the head (3), retaining its position whilst there is no greater actuating force.

The guide rule (2) is a one-piece, extended body which is arranged horizontally. At one of its end zones it is fixed to the sloping anvil (13) by means of, for example, screws (24) and at the opposite end zone a support (21) has been provided which avoids tilting.

This guide rule (2) forms the point-bending cavity (23) for the staples—opposite the stapling zone of the head (3) and, of course, on the anvil (13)—and, over its entire width, positioning shapes (22) have been provided which serve for aligning catalogues, books or leaflets to be stapled; in a manner such that objects with an identical format have the staple(s) arranged in one and the same zone.

The stapling-machine head/staple holder (3) is not described in greater detail since it is known per se and, therefore, is not a fundamental subject of the present invention.

I claim:

1. A stapling machine comprising:

(a) a one-piece support base capable of flexing and having two wings, one wing for carrying a stapling-machine head/staple holder, and another wing for support of an anvil arm, said anvil arm extending upwards towards the stapling machine head/staple holder and backwards towards the back of the stapling machine, said two wings being connected together via a curved core;

(b) a guide rule fitted on said anvil arm, said guide rule having a point-bending cavity along its top edge opposite the stapling head, said point-bending cavity being vertically spaced from said support base when said stapling machine is in its normal operating position.

2. The stapling machine of claim 1 wherein the stapling machine head/staple holder is mounted so as to articulate on said support base and includes a spring plate fixed to said support base and on which the stapling machine head/staple holder rests, so that the stapling-machine head/staple holder tends to remain in one position.

3. The stapling machine of claim 1 wherein said guide rule is constructed as a one-piece body arranged transversely on the anvil arm via one of its end zones and defining a support at the opposite end zone and positioning shapes distributed over its entire width so that the staples are accurately positioned on identical items whilst at the same time avoiding tilting of said rule during stapling.

4. A stapling machine comprising: (a) a support base; (b) a stapler head/staple holder attached to one end of said support base; (c) an anvil arm at the other end of said support base, said anvil arm extending upwards towards the stapler head/staple holder and backwards towards the back of the stapling machine; (d) a point-bending cavity at the top of said anvil arm; and further comprising a guide rule fitted on said anvil arm, said guide rule having said point-bending cavity along its top edge opposite the stapling head/staple holder, said poine-bending cavity being vertically spaced from said support base when said stapling machine is in its normal operating position.

5. The stapling machine of claim 4 wherein the stapler head staple holder is mounted so as to articulate on said support base and has a spring plate attached to said support base and on which the stapler head/staple holder rests.

6. The stapling machine of claim 4 wherein said guide rule is a one-piece body arranged transversely on the anvil arm at one of the ends of the guide rule and having a support at the opposite end and positioning shapes distributed over its entire width.

* * * * *